US005520731A

United States Patent [19]

Esser et al.

[11] Patent Number: 5,520,731

[45] Date of Patent: May 28, 1996

[54] DOCTOR BLADE FOR USE IN COATING CONTINUOUS STRIPS OF MATERIAL OR SIMILAR SUBSTRATES

[75] Inventors: Reinhard Esser; Helmut Graab, both of Bergisch-Gladbach; Claus Martin, Hennef/Sieg, all of Germany

[73] Assignee: Zanders Feinpapiere AG, Bergisch-Gladbach, Germany

[21] Appl. No.: 350,723

[22] Filed: Dec. 7, 1994

Related U.S. Application Data

[63] Continuation of Ser. No. 862,569, filed as PCT/EP91/01985, Oct. 19, 1991, published as WO92/06796, Apr. 30, 1992, abandoned.

[30] Foreign Application Priority Data

Oct. 20, 1990 [DE] Germany ..... 40 33 481.3

[51] Int. Cl.[6] ..... B05C 11/04

[52] U.S. Cl. ..... 118/126; 118/413

[58] Field of Search ..... 118/126, 413

[56] References Cited

U.S. PATENT DOCUMENTS

| | | | |
|---|---|---|---|
| 3,611,841 | 10/1971 | Froden | 76/101 R |
| 4,133,917 | 1/1979 | Wallstén | 427/209 |
| 4,184,429 | 1/1980 | Widmer | 101/169 |
| 4,201,297 | 5/1980 | Datwyler | 206/349 |
| 4,780,336 | 10/1988 | Damrau | 427/356 |

*Primary Examiner*—Matthew O. Savage
*Attorney, Agent, or Firm*—Baker & Daniels

[57] ABSTRACT

The aim of the invention is to make it possible to vary independently of each other, i.e. better and more freely, the basic parameters in the design of a squeegee used as a flexible-plate doctor blade in a coating-material spreading device. These parameters may include the length of the chamfered surface in contact with the surface to be coated, the resistance to bending strain parallel to the spreading edge of the blade and the resistance to bending strain at right angles to the spreading edge of the blade. This aim is achieved by virtue of the fact that the flexible-blade doctor blade (squeegee) proposed does not have a constant thickness but is made up of two or more different cross-sections with steps parallel to the dosing edge, thus giving the flat sides of the doctor blade a substantially terrace-like structure. The blade may also have grooves parallel to the dosing edge.

4 Claims, 4 Drawing Sheets

DOCTOR BLADE FOR USE IN COATING CONTINUOUS STRIPS OF MATERIAL OR SIMILAR SUBSTRATES

This is a continuation of application Ser. No. 07/862,569, filed as PCT/EP91/01985, Oct. 19, 1991, published as WO92/06796, Apr. 30, 1992, now abandoned.

BACKGROUND OF THE INVENTION

The invention relates to a doctor blade element clamped at its one end in a holder, with an obliquely formed chamfered metering surface for the coating or metering of a composition onto a web of material or a roll continuously moving at a constant rate. Such a doctor blade element is disclosed in the German patent publication 2,637,827 A1, and the German patent publication 2,939,906 A1 and furthermore the periodical "Der Polygraph" 9/74, pages 608 through 612.

For the coating of webs of material, more particularly spread coating on paper or board, it frequently occurs that a doctor blade element having the form of a strip spring, a so-called spreading blade, is utilized for metering out the coating composition on the length of material or furthermore on a support or applicator roll, which at its metering end has an oblique chamfered metering surface, which is thrust by a support against the web of material or an applicator roll. In this respect the coating weight is predetermined by the equilibrium between the mechanical force at the metering surface and the hydrodynamic opposing force of the composition utilized for coating. This equilibrium may frequently be disturbed by fluctuations in the properties of the paper, of the coating composition, of the elastic cover of the support roll bearing the web of material or of the carrying system for the doctor blade element. The elasticity of the spreading blade, which is generally manufactured of spring steel, is to a certain extent able to compensate for such interfering factors so that generally a stable equilibrium is maintained. Should another coating weight be desired or if a parameter—such as for instance the web speed—is modified, it is then necessary for the mechanical force acting on the chamfered metering surface to be altered.

In the case of the initially mentioned German patent publication 2,637,827 A1 an attempt was made to use a very thin construction of the coating blade in the metering zone in order to avoid or substantially reduce the danger of streaking owing to solid particles lodged underneath the chamfered metering surface. In the case of the two other publications the intention was to obtain a more even application of the ink over long periods of time by constant dimensions and geometry of the doctor blade in the part to be subjected to wear.

In contradistinction to this the aim of the present invention is to substantially increase the strength or rigidity of the blade and its self-vibration characteristics as regards producing a high degree of smoothness of the coating and to increase the coating weight range during coating with a blade.

However it would be generally an advantage if it were possible to make greater variations in the mechanical force at the chamfered metering surface in the case of a coating blade than has hitherto been the case. It would then be possible to cope with a greater range of variation in the weight of coating.

SUMMARY OF THE INVENTION

An object of the invention is to reduce the limitation in the range of variation of the thrust forces by a suitable design of the blade in order in this manner to be able to provide a greater range of application than has so far been the case.

It has been recognized by the inventor that the reason for the considerable limitation in the range of parameters during coating with a blade is because there is a connection between the thickness of the blade and the length, dependent thereon, of the chamfered metering surface (in the case of comparable angles and as seen in the direction of travel of the web), the flexural stiffness as dependent on the thickness of the blade in the direction of travel of the paper and on the flexural stiffness of the blade in the transverse direction.

For instance in the case of a blade with a constant thickness a high coating weight is tied to a low loading thrust. In this respect the blade is only tensioned and bent to a slight extent and in this working position it will be weak both in this working position and also in a direction perpendicular thereto. The lack of transverse and longitudinal rigidity leads to an uneven distribution of the coating in the transverse and in the longitudinal directions.

Furthermore the blade is quite prone to self-vibration which is responsible for an inferior distribution of the material to be applied within a range of some millimeters (so-called cloudiness or step formation in the applied coating).

Conversely a low coating weight is mutatis mutandis connected with a high loading thrust and pronounced flexure of the blade and thus with a greater longitudinal and transverse rigidity. Therefore the desired elastic flexure, as already mentioned, of the coating blade is less satisfactory. Fluctuations are less well compensated for than in the case of a more elastic behavior.

One feature of the invention is that significant factors including the length of chamfer of the metering edge, the flexural stiffness along the coating edge and the flexural stiffness transversely in relation to it, are no longer linked to each other and that the self-vibration of the blade may be caused to take place in a higher frequency range by having a greater blade tension, such range no longer being responsible for an undesired effect on the quality of the coating. This is ensured in such a manner that the doctor blade elements in accordance with the invention having the form of a strip spring (as coating blades) do not have a constant thickness and in fact have two or more different cross sections.

It may be seen from the theory of elasticity that the flexural stiffness of the blade is proportional to the third power of the thickness of the blade. Therefore the flexural stiffness of the blade in the transverse direction increases in the vicinity of tip of the blade in the case of a blade which is thicker at the tip.

In the thinner part of the blade the flexural stiffness is accordingly substantially lower, that is to say the result is a blade which in the direction of movement behaves like a weak spring while in the transverse direction at the tip it behaves like a hard spring.

The coating effect consequently has a greater leveling action than in the case of a blade with a constant thickness: the surface of the coating becomes more even. Conversely when coating using a blade which is thinner at the tip, the loss of flexural stiffness at the tip is minimized by making the thin part of the blade very short. The thin blade area may additionally be hardened in order to raise the modulus of elasticity. In addition to this it is possible for there to be a specifically designed rib part directly in the transitional part between the thin and the following thicker part, such rib part substantially increasing the flexural stiffness in the transverse direction and additionally modifying self-vibration.

In this respect the coating blade in accordance with the invention may have a minimum thickness of 0.25 mm, while in the case of the known arrangement of the type initially mentioned in the case of a chamfer angle of the metering surface of at the most 20° the maximum thickness amounts to 0.17 mm and preferably 0.14 mm. Furthermore the engagement angles of the doctor blade element resembling a strip spring (i. e. a coating blade) are substantial and are equal to 25° to 45° and preferably 30° to 35°. This angle practically constitutes the chamfer angle between the chamfered metering surface and the upstream broad side of the coating blade, i.e. the angle α.

BRIEF DESCRIPTION OF THE DRAWINGS

The invention will now be described in following account of working embodiments of the invention as illustrated in the drawings.

DETAILED DESCRIPTION OF THE INVENTION

Herein the term strip spring is used in the sense of an element, which practically constitutes a piece of thick foil of highly elastic material, such material being able to be both a metal such as hardened or alloyed steel, or a highly elastic composite synthetic resin.

In FIGS. 2 through 7 the breadth dimension of the elements is naturally exaggerated in relation to the length of the illustrated cross sections. The cross section of the doctor blade elements is here practically illustrated in side view as the outline, as is also the case in FIG. 1.

Figure 1:
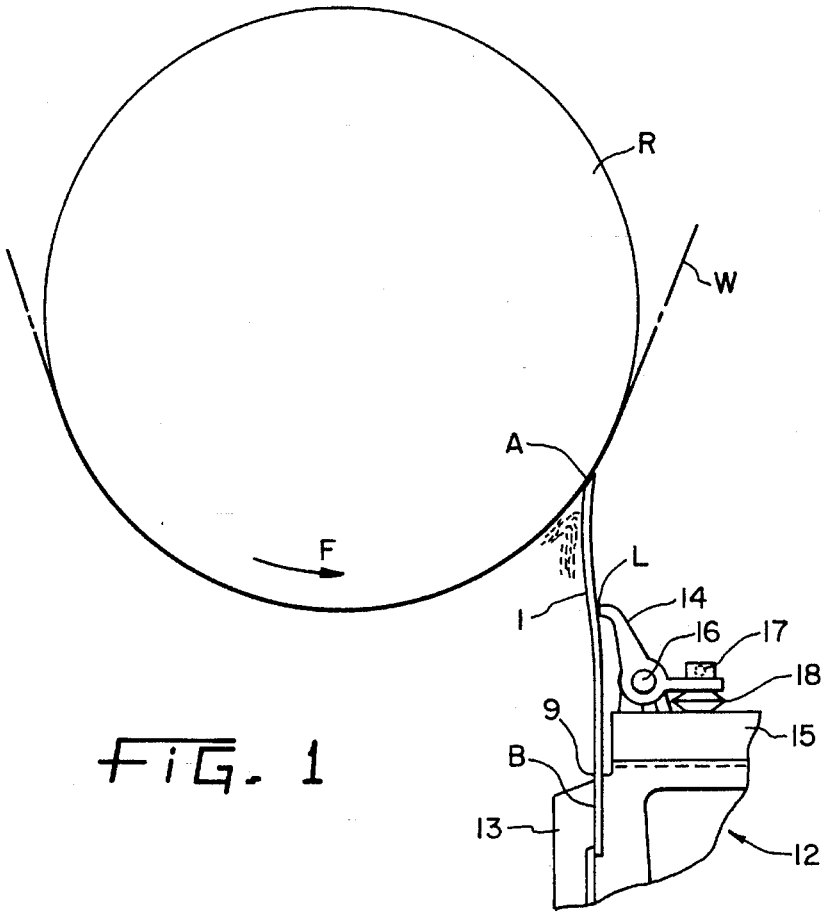
FIG. 1 is a side view of a conventional coating device using a blade in accordance with the invention.

In FIG. 1 the support or applicator roll R bearing the web W of material is only illustrated diagrammatically. The direction of rotation is as indicated by the arrow F. The coating blade representing the strip spring doctor blade element 1 is so arranged that the chamfered metering surface A is in engagement with the applicator roll R or, respectively, the web W of material. If this chamfered metering surface is relatively broad as in the case of FIGS. 2, 4 and 6, the said surface should naturally be ground in alignment with the direction of coating prior to putting into operation. Furthermore this angle α between the chamfered metering surface A and the upstream broad side of the doctor blade element which is in engagement with the applicator roll, has to be very accurately set and maintained. For this purpose it is necessary to have regulating means as are for instance described in German patent 2,913,421. An even more exact regulating device is described in the German patent application 3,937,322. The doctor blade includes upstream and downstream broad sides that are planar and parallel to one another and form upstream and downstream metering edges with a substantially planar chamfered metering surface respectively. The chamfer angle "α" is formed between the downstream broadside and chamfered metering surface. The "complementary angle" is formed between the upstream metering edge and chamfered metering surface and is equal to 180° minus α.

The upstream broad side of the coating blade 1 with the upstream metering edge 8' is in this case the left side, as is indicated by the drips of coating composition as shown in broken lines. The web of material receives this excess of coating composition somewhere upstream from the support or applicator roll R or in the vicinity of the angle of bend of the web W of material about the applicator roll R, this not being illustrated in detail. The same applies, if the coating composition is firstly only applied to the roll.

The coating blade 1 is here clamped and held in a holder 12 with a clamping rail 13. One end of the doctor blade is a clamped end portion B on the coating blade at its end opposite to the chamfered metering surface A. The coating blade is thrust upon by loading plates 14 in its part freely extending out of the holder, such plate 14 being in this case constituted by levers, adjustment in length of such levers being possible by means of screws 17 and belleville washers 18 in order to practically set the thrust acting on the coating blade. A basic adjustment is produced using the sliding plate-like carrier 15 for the loading plates 14. This way of holding for the coating blade is however only given as an example from a plurality of similar devices in the prior art. At the outlet of the coating blade from the holder there is at the end of the clamped end portion B a clamping line C on the end 9 (which is here the upper end) of clamping means or, respectively, a clamping rail 13.

Figure 2:
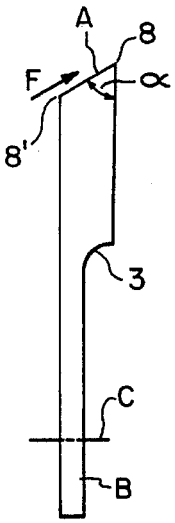
FIGS. 2 through 11 show embodiments of the doctor blade element resembling a strip spring in accordance with the invention.

FIG. 2 shows a design of the strip spring doctor blade element in accordance with the invention, in the case of which the metering surface A is very broad and accordingly furthermore the so-called coating blade has a corresponding thickness. In this figure, as well as in the other figures, the direction of movement of the web of material or the surface of the support or applicator roll is as indicated by the arrow F so that the upstream broad side of the coating blade is here in any event the left side. In all the figures the line of clamping is denoted by the letter C as shown in broken lines. In FIG. 2 there is a reduction in cross section at the step 3 so that towards the clamped end the coating blade becomes relatively smaller in its cross section. This blade is more particularly intended for high weights of application, in the case of which there will be a low thrust at the line L and correspondingly a low blade clamping effect. Owing to the great length of the chamfered metering surface A and owing to the greater thickness as far as step discontinuity 3 it is necessary for the clamping action of the blade to be considerably increased. Therefore it is possible to operate with the desired high weight of coating and simultaneously this blade will be bent to a greater extent in accordance with the greater blade tension and therefore it will be more rigid or stable.

In the converse case (see FIG. 3)—that is to say in the case of a very low weight of application—the chamfered metering surface A is relatively short and in this part the coating blade is relatively thin as far as a step discontinuity 2. The loading forces transmitted by the loading plates 14 are distributed only onto the smaller chamfered metering surface, something contributing to an increase in the loading thrust. Owing to the design in accordance with the invention with—as in this case—two different thicknesses, it is possible for the elasticity of the coating blade to be maintained within the desired range.

It is useful if the single step discontinuity 2 (FIG. 3) is placed at a distance from the downstream metering edge 8 equal to 0.04 to 0.5 times the distance between this metering edge 8 and the clamping line C.

The blades in accordance with the invention make it possible to substantially increase the present day limits for coating with coating blades to achieve the following:

a higher weight of application a lower machine speed a higher dry matter content and reversed parameters or combinations thereof better control of self-vibration of the blade.

Figure 3:
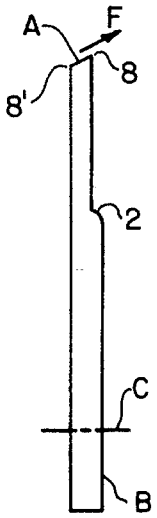
Figure 4:
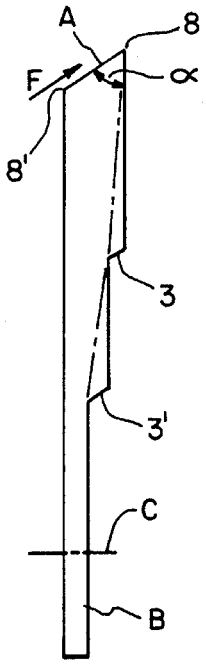
Figure 5:
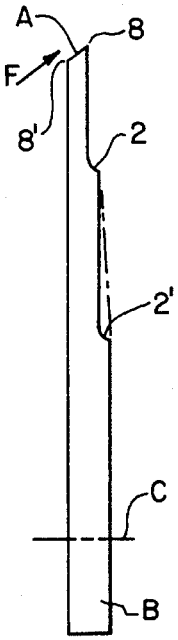

In the embodiments of the invention illustrated in FIGS. 4 and 5 in the case of blades for the application as in FIGS. 2 and 3 two steps 2 and 2' and, respectively, 3 and 3' in thickness are provided. Thus as shown in broken lines in FIGS. 4 and 5 the change in cross section may also be stepless in order to approximate the change in cross section close to the computed step discontinuities as far as possible.

Figure 6:
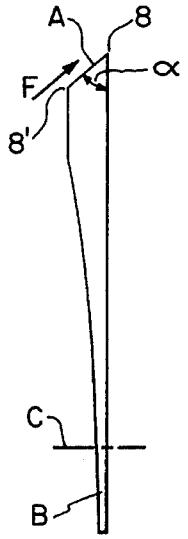
Figure 7:
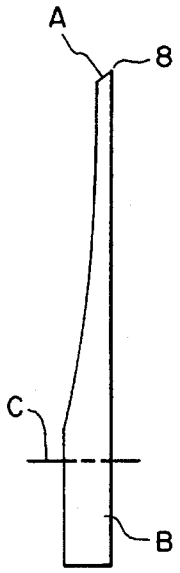

In FIGS. 6 and 7 there is an overwhelmingly even change in cross section from the chamfered metering surface A as far as the clamped end of the doctor blade elements. In this respect it is a question of first terrace which always has a constant thickness in order to ensure that despite wear of the blade the length of the chamfer be constant.

Referring again to FIG. 4, it is preferred for the first step discontinuity to be at a distance from the downstream metering edge 8 equal to between 0.04 and 0.5 times the distance between the metering edge 8 and the clamping line C and the second step discontinuity in a corresponding range between 0.06 times and 0.8 times the said distance from the first step discontinuity.

In the case of a coating blade with a single discontinuity, such as that displayed in FIG. 2, it is preferred that the second step thickness be 5% to 83% of the first step thickness. While in the case of a coating blade with two step discontinuities, such as that displayed in FIG. 4, the second step thickness is preferably 6% to 75% of the first step thickness and the third step thickness is preferably equal to 25% to 83% of the second step thickness.

Referring to FIGS. 2, 3, a single step discontinuity 3, 2, respectively, is preferably placed at a distance from the downstream metering edge 8 equal to between 0.04 times and 0.3 times the distance between the downstream metering edge and the clamping line C. Referring to FIG. 2, it is then also an advantage if the thickness of the second step thickness is between 150% and 240% of the first step thickness.

In general, where there are two step discontinuities, it is furthermore preferred to provide the first step discontinuity at a distance from the downstream metering edge 8 of between 0.25 times and 0.4 times the distance between this metering edge 8 and the clamping line C and to provide the second step discontinuity in a range between 0.4 times and 0.8 times the said distance. In this case it is preferred to make the thickness of the second step equal to between 120 and 200% of the thickness of the first step and the thickness of the third step equal to between 120 and 200% of the thickness of the second step—in each case as measured from the chamfered metering surface A.

Figure 8:
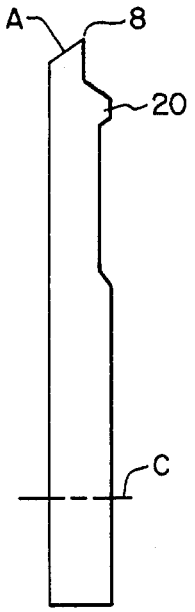

Furthermore in accordance with FIG. 8 it is possible to provide a stiffening rib 20 extending parallel to the metering edge 8 in the form of a rail. This locally very limited increase in the cross section is intended to increase the transverse flexural stiffness at the tip of the blade and to produce a favorable change as regards the self-vibration of the blade at the tip. This rib is preferably at the most 5 mm thick and 3 mm broad and may start at a minimum distance from the metering edge 8 of 2 mm.

The rise or fall of this rib may be perpendicular or oblique and the rib may be straight or curved.

Figure 9:
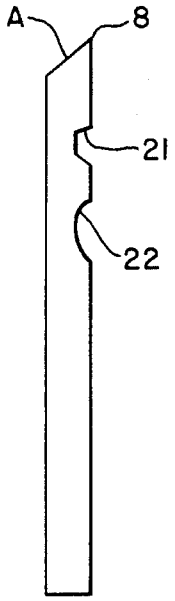

FIG. 9 shows that a change in the cross section of the blade may also be produced by having grooves 21 or 22 parallel to the metering edge 8.

Figure 10:
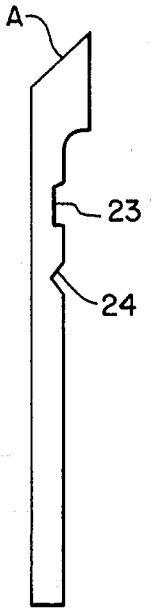

Additional grooves may also be provided in accordance with FIG. 10 in the case of a coating blade designed with step discontinuities. These grooves 21, 22, 23 or 24 may be rectangular, trapezoidal, rounded or triangular. It is possible for the grooves or steps to be produced by removing material, preferably by grinding, milling, chemical or electrochemical milling, micro sand blasting or by similar methods, or also by laser light.

The additional grooves are preferably produced in the second step in order to provide for a further precise optimization of the longitudinal and transverse stiffness and of the self-vibration behavior of the doctor blade element.

In this respect the grooves preferably have a breadth of 0.1 to 05 mm and a depth of 0.1 to 0.75 mm, the minimum thickness of the doctor blade element of 0.25 mm also applying for the grooved part thereof.

Furthermore it is possible to have a provision such that adjacent to the chamfered metering surface A the blade is additionally hardened in order to increase the modulus of elasticity. In this respect the hardening should be so performed, for instance using hardening followed by annealing or laser hardening, that the hardness of the surface part of the chamfered metering surface less and increases thereunder so that the new coating blade inserted into the holder 12 is able to adapt itself by abrasion to the fine irregularities of the paper or of the applicator roll during the so-called running in or grinding in process as regards the engagement angle.

In order to make an even further improvement in the vibration behavior of the blade it may be best to apply bands or plates of metal, synthetic resin or rubber or combination thereof, to the blade adjacent to the point B of clamping. These additional bands or plates are preferably connected with each other and to the base material of the coating blade by rivets or screws. The selection of which pairs of the metals are to be utilized is made in accordance with measurements of the self-vibration, which are evaluated.

Figure 11:
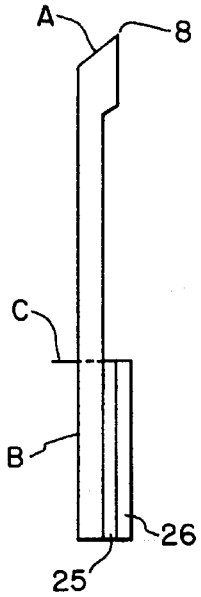

A diagrammatic view of this arrangement is to be seen in FIG. 11. In this case the coating blade shown there firstly has a band 25 of synthetic resin bonded to it and thereon a band 26 of a further metal. The band 25 may also consist of rubber.

With respect to the German patent publication 2,939,906 A1 it is to be noted that no data are given. However it appears from the drawings that no ground chamfer is present so that therefore no stiff blade manner of operation is possible to which our claims are exclusively directed.

Furthermore it is to be recognized that the first step at the tip is relatively long. Accordingly such blade may not be utilized in order to for instance apply high viscosity knife coating materials at a low rate and at a high velocity.

As regards the MDC Ringier doctor it is to be noted that the blade is so thin at the leading edge that rigidity is approximately 100 times less than in the case of our thinnest blade range of 0.25 mm. The method of production by electrochemical etching would furthermore be uneconomic for our stepped blades owing to the small depth of removal.

Either blade would be unsuitable for our applications for the above noted reasons.

Figure 12:
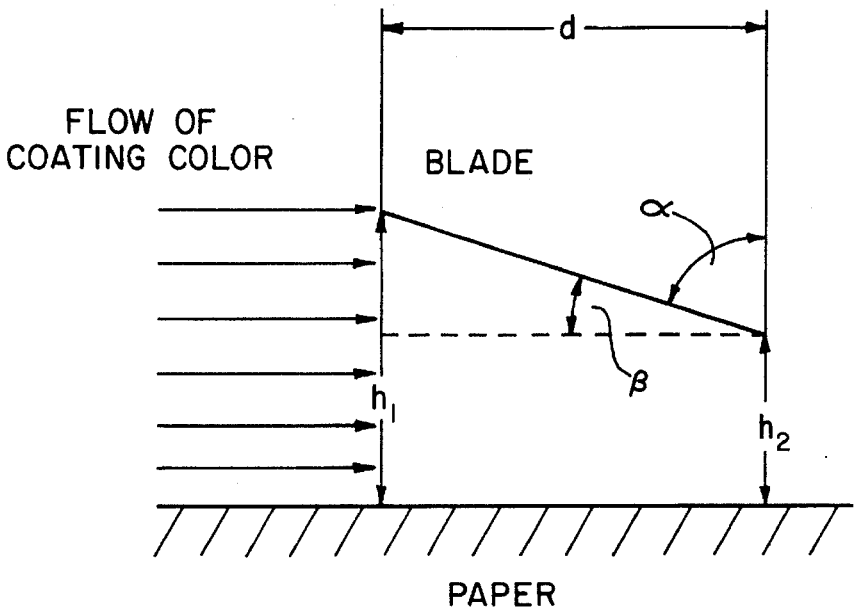
FIG. 12 is a schematic illustration of the coating flow and blade chamfer.

In what follows some remarks are to be made on the hydrodynamic forces, which act on the blade during knife coating with the aid of FIG. 12 which provides a schematic illustration of the coating flow and blade chamfer.

The forces which are exerted by the knife coating material on the blade chamfer may be approximately calculated using the equation for a flat plain bearing.

Since the angle of inclination β of the chamfer in relation to the paper is unknown it must be regarded as a fit parameter and be determined empirically.

However a later geometrical interpretation is likely to be misleading. It seems that the flow conditions underneath the blade chamfer are substantially more complex than has been assumed in the derivation of this equation. Nevertheless the equation is a help in approximately estimating the influence of the different parameters $$F_{\perp}=\frac{6\eta v d^2 \ln k}{(k-1)^2 h_2^2}-\frac{2(k-1)}{k+1} \quad \text{force vertical to chamfer}$$

$$F_{\parallel}=\frac{\eta v d 4 \ln k}{(k-1) h_2}-\frac{6(k-1)}{k+1} \quad \text{force parallel to chamfer}$$

$k=h_1/h_2$ $\eta$=viscosity $h_1$=wet film thickness at leading edge of the chamfer $h_2$=wet film thickness at trailing edge of the chamfer d=blade thickness at the tip of the blade v=velocity of paper web It will be seen that the two force components are linearly dependent on $\eta$ and v, whereas the vertical component has a square law dependence on the thickness of the blade.

Since however d is implied in $h_1$, this dependence is further modified. Using this equation it is possible to approximately calculate the forces, which are exerted on the blade chamfer by the knife coating material and select a suitable blade therefor.

In the following some remarks are made with respect to the calculation of the line of flexure of the blade:

The flexure of the blade may be calculated with a second order differential equation:

$$EI\frac{d^2y}{dx^2}=M(x)$$

wherein:

E=modulus of elasticity

I=b $d^3/12$ moment of inertia d=thickness of blade b=breadth of blade m(x)=moment of flexure E characterizes the material of the blade, I the blade geometry and M(x) the system holding the blade, the points of support and the forces, which act on the blade.

The maximum permissible blade flexure is in the case of most coating plant limited to approximately 10% to 15% of the free length of the blade (the free blade length being the distance between the blade tip and the holding means).

Accordingly maximum force at the tip of the blade is also set, if all other parameters are kept constant.

If the material of the blade, the blade geometry or the action of forces on the blade are altered, the force acting at the blade tip may be altered as well.

Therefore in practice the blade is replaced and another ground chamfer or another blade thickness is selected in order to make a greater change in the effective thrust of the blade underneath the chamfer than would be possible by flexure of the blade alone.

It will be seen from the following table 1 how the flexural rigidity of the blade varies with the thickness of the blade:

| d (mm) | I (8.33 E-13 $m^4$) |
|---|---|
| 0.1 | 1 |
| 0.2 | 8 |
| 0.3 | 27 |
| 0.4 | 64 |
| 0.5 | 126 |
| 0.6 | 216 |

With knife coating paper blade thicknesses of 0.3 to 0.4 mm are mostly employed. In the case of thick blades it would admittedly be possible to produce smaller forces so that in principle a larger force range could be dealt with, but adjustment is not sufficiently fine.

If the flexural forces are too small in relation to the maximum force, the different residual stresses of the blade have a greater influence and lead to poorer transverse sections of the coating action.

In general the thickness of the blade should always be so selected that the knife coating material may be applied with a medium flexure of the blade so that the blade is firmly in engagement with the mating roll while there is still sufficient play for adjustment operations.

Assuming a change in the blade thickness from, for instance, 0.3 to 0.4 mm the maximum possible force will be doubled. Since this amount of change is too coarse for practical applications, blades with different chamfer angles are on the market so that the chamfer length may be different for the same blade thickness.

Owing to the selection of different chamfer lengths there is also however a correspondingly finer graduation of the thrust underneath the blade chamfer.

Despite there possibilities of variation knife coating is relatively limited owing to the dry matter content of the coating material, its viscosity and the paper speed. There are some further factors as well.

If blades with two or more cross sections are employed the chamfer length is no longer tied to the thickness of the blade.

This means that there is an additional free parameter, which may be considerably as desired. For each step there is a differential equation, such equations however being coupled at the points of discontinuity, since the blade flexures are equal at the point of discontinuity, and furthermore the tangent slopes are equal.

At the point of the support and at the holding means the blade flexure is zero. It is generally impossible to predict the slope of the tangent.

The solution to the equations is possible with this method but it is not practical because the formulas are extremely complex.

Therefore it is better to solve the equations directly numerically, for which purpose it is possible to use standard methods of numerical mathematics as for instance the formulas of Runge and Kutta or finite element methods.

At the tip of the blade it is necessary for the blade angle to be calculated at the tangent of the line of flexure of the blade, since the blade has to be turned through this angel about the tip in order to ensure that the blade chamfer keep parallel to the starting setting.

The perpendicular and the parallel force components of the blade chamfer have to be calculated with this angle and with the chamfer angle of the blade.

In the following, the line of flexure for a blade with three steps will be calculated by way of example using the Heavyside step function method.

The result is then a single formula for the complete flexure line, the setting of the support point then being able to be freely selected.

This represents the great advantage of this method of calculation as compared with the above noted methods.

Figure 13:
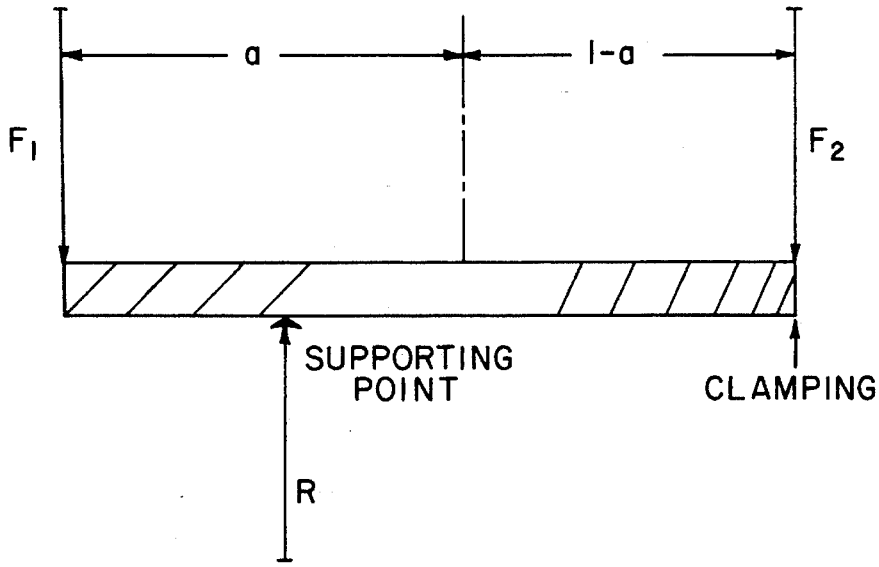
FIG. 13 is a schematic illustration of the forces acting upon the blade.

Calculation of the Line of Flexure of Blade with Three Steps (FIG. 13: forces, which act at the blade)

$R=F_1+F_2$ equilibrium of forces $a\ F_1=(I-a)\ F_2$ equilibrium of torque

From these two equations we have:

$F_2=a\ F_1/(1-a)$ $R=1\ F_1/(1-a)$

For the torque, which causes the blade flexure, the following applies: $I_1$ is the surface moment of inertia of the first step at the blade tip. Then:

$I_1=d^3/12$ related to the width of the blade, d being the blade of 1 m., thickness.

For the second step we have: $I_2=m\ I_1$

For the third step we have: $I_3=n\ I_1$

E is the modulus of elasticity of the blade.

The conventional differential equation for the calculation of the blade:

$$EI\frac{d^2y}{dx^2}=M(x)$$

has to be solved for the step blade in the following:

$$I_1E\frac{d^2y}{dx^2}=$$

$$[-F_1x+R(x-a)Ha][1+Hx_1(1/m-1)+Hx_2(-1/m+1/n)]$$

The first step is at the distance $x_1$ from the blade tip and the second step at the distance $x_2$ from the blade tip.

This second order differential equation has to be integrated twice:

$$y(x)=1/(I_1E)[-F_1X^3/6-F_1\ ((1-m)/m))\ Hx_1(x^3/6-x_1^2x/2-x_1^3/6+x_1^3/2)-F_1(-1/m+1/n)Hx_2(x^3/6-x_2^2x/2-x_2^3/6+x_2^3/2)+RHa\ (x-a)^3/6+R(1/m-1)Ha((x-a)^3/6-(x_1-a)^2x/2+(x_1-a)^2a/2)+R(-1/m+1/n)Ha\ ((x-a)^3/6+(x_2-a)^2x/2+(x_2-a)^2a/2)+C_1x+C_2]$$

Ha is a jump function.

For these jump functions the following rules of calculation are valid:

| | | |
|---|---|---|
| $Ha=0$ | if | $x<a$ |
| $Ha=1$ | if | $x>=a$ |
| $Hb=0$ | if | $x<a$ |
| $Hb=1$ | if | $x>=b$ |
| $Ha,Hb=0$ | if | $x<b$ and if $a<b$ |
| $Ha,Hb=1$ | if | $x>=b$ and if $a<b$ |

-continued $$\int_0^x Haf(x)dx=Ha\int_a^x f(x)dx$$

EXAMPLE 1

$$\int_a^x Hax^2dx=$$

$$Ha\int_a^x x^2dx=[Hax^3/3]_a^x+C=Ha(x^3-a^3)/3+C$$

EXAMPLE 2 when b>a $$\int_a^x HbHa(x-a)dx = Hb\int_b^x (x-a)dx = Hb\ [(x-a)^2/2]_b^x+C = Hb[(x-a)^2-(b-a)^2]/2+C$$

The constants of integration $C_1$, $C_2$ are calculated on the grounds of the two boundary conditions:

$y(a)=0$ $y(l)=0$

Now noting the following $$C_1=1/1[1/(1-a)(-A+aB/1)-B]$$
$$C_2=1/(1-a)[-A+ab/1]$$

$$A=-F_1a^3/6-F_1((1-m)/m)Hx_1(a^3/6-ax_1^2/2-x_1^3/6+x_1^3/2)-F_1(-1/m+1/n)Hx_2(a^3/6-ax_2^2/2-x_2^3/6+x_2^3/2)+R((1-m)/m))Ha[-(x_1-a)^2a/2+(x_1-a)^2a/2]+R(-1/m+1/n)Ha[-(x_2-a)^2a/2+(x_2-a)^2a/2]$$

Noting further the following inequalities:

| | | |
|---|---|---|
| $Ha=1$ | | |
| $Hx_1=0$ | if | $x_1<a$ |
| $Hx_2=0$ | if | $x_2<a$ |
| $Hx_1=1$ | if | $x_1>=a$ |
| $Hx_2=1$ | if | $x_2>=a$ |

$$B=-F_1\ l^3/6-F_1((1-m)/m)Hx_1(l^3/6-1x_1^2/2-x_1^3/6+x_1^3/2)-F_1(-1/m+1/n)Hx_2(l^3/6-x_2^21/2-x_2^2/6+x_2^3)+RHa\ ((1-a)/6)^3+R((1-m)/m)Ha\ [(1-a)^3/6-(x_1-a)^31/2+(x_1-a)^2a/2]+R(-1/m+1/n)Ha\ [(1-a)^3/6-(x_2-a)^21/2+(x_2-a)^2a/2]$$

Noting thereto the following inequalities:

$Hx_1=1$ $Hx_2=1$ $Ha=1$ and noting $x_1,x_2,a<1$.

A. The influence of the chamfer length upon thrust.

Figure 14:
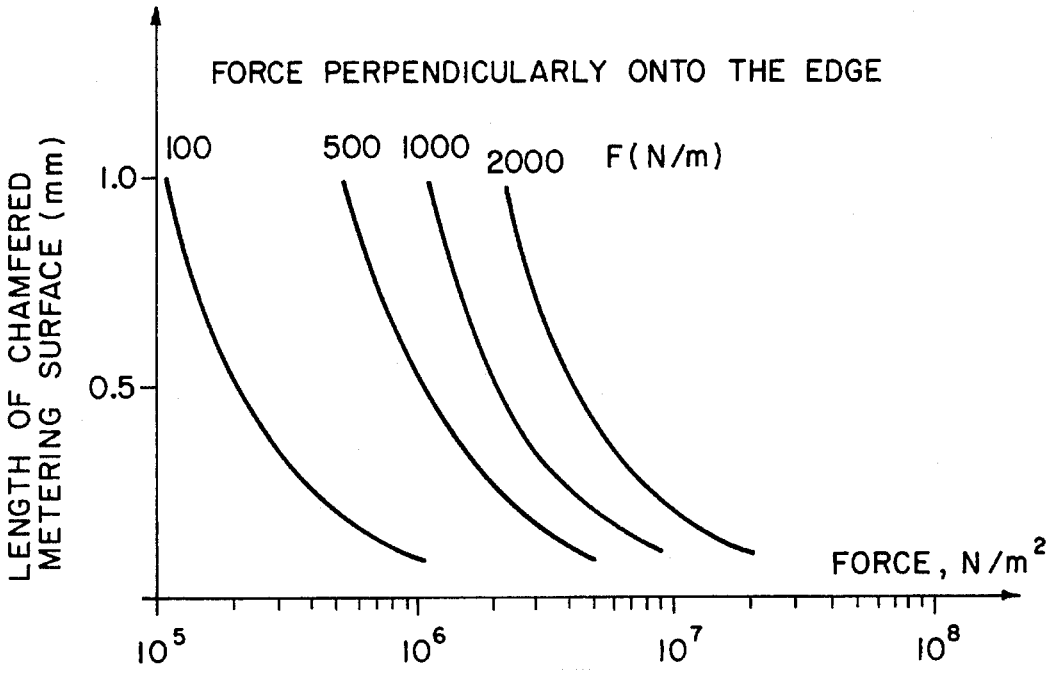
FIG. 14 is a graph illustrating the influence of the chamfer length upon the thrust.

FIG. 14 indicates how for a given force acting perpendicularly to the blade chamfer there is a change in the thrust changes as function of chamfer length.

In this figure it is necessary to note that the x axis is logarithmically scaled.

It will be seen that it is possible to produce an assortment of blades with different thicknesses and chamfer lengths such that the pressure ranges will still sufficiently well overlap after the replacement of the blade by a blade with a different thickness.

B. Modification in transverse strength of the blade as dependent on the thickness and the width of the step.

Figure 15:
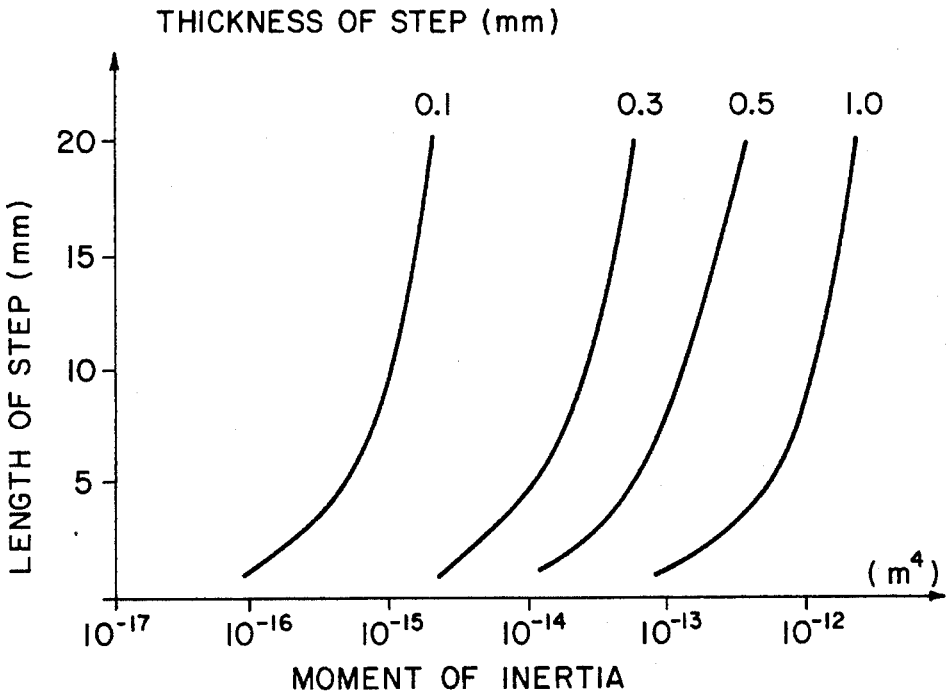
FIG. 15 is a graph illustrating the influence of the step thickness and length upon the transverse blade strength.

In FIG. 15 the surface moment of inertia for flexural rigidity of the blade in the transverse direction has been plotted along the x axis.

The additional thickness for the step is employed as a parameter for the family of curves. The length of the step is plotted along the y axis.

It will be seen that by having different thicknesses of the step the rigidity may be varied within very wide limits and that by varying the length of the step a very fine graduation is possible.

It will be seen from the two graphs that there are great possibilities of variation owing to no longer having the chamfer length dependent on the blade thickness and that by making a suitable selection of the steps or grooves the transverse flexural rigidity of the blade may be modified additionally.

We claim:

1. A resilient, strip doctor blade element adapted to be clamped at a clamped end portion along a clamping line, in a holder, with an obliquely formed chamfered metering surface for the coating or metering of a composition onto a web of material or a roll continuously moving at a constant rate, the chamfered metering surface located at an end of said blade element opposite said clamped end portion, wherein said blade element includes parallel upstream and downstream broad sides which define an upstream metering edge and a downstream metering edge with said chamfered metering surface, respectively, the doctor blade element having at least one modification in a cross section thereof along at least one line or edge parallel to one of the downstream metering edge and chamfered metering surface, wherein the doctor blade has a change in cross sectional thickness which is provided between the clamping edge and the chamfered metering surface either continuously or in at least one step discontinuity, the doctor blade having a first thickness adjacent the chamfered metering surface and a second thickness at the clamping edge, said first thickness greater than said second thickness, a chamfer angle $\alpha$, formed between said downstream broad side and said chamfered metering surface, being between 25° and 45°, and a complementary angle, formed between said upstream broad side and said chamfered metering surface, being equal to 180° minus said chamfer angle $\alpha$.

2. The doctor blade element as claimed in claim 1, wherein the change in thickness is in at the most two step discontinuities in a terraced structure, not including the clamped end portion of the doctor blade element.

3. The doctor blade element as claimed in claim 1, wherein the at least one step discontinuity comprises a single step discontinuity disposed at a distance from the downstream metering edge equal to 0.04 times to 0.3 times the distance between the downstream metering edge and said clamping line.

4. The doctor blade element as claimed in claim 1, wherein said at least one step comprises a single step discontinuity disposed between a first step thickness and a second step thickness, the first step thickness being located between the chamfered metering surface and the second step thickness, and the second step thickness being equal to 5% to 83% of the first step thickness.

* * * * *